US005263717A

United States Patent [19]

McCallister

[11] Patent Number: 5,263,717

[45] Date of Patent: Nov. 23, 1993

[54] GOLF CLUB WITH SWING DIRECTING RIDGE

[76] Inventor: John McCallister, 1270 N. Hidden Springs, Agoura, Calif. 91301

[21] Appl. No.: 911,873

[22] Filed: Jul. 10, 1992

[51] Int. Cl.[5] ..... A63B 53/00

[52] U.S. Cl. ..... 273/164.1; 273/167 J; 273/167 G

[58] Field of Search ..... 273/80.2-80.8, 273/167 R, 167 G, 164.1, 163 R, 167 D, 167 F, 167 J, 186.2, 187.6; D21/220

[56] References Cited

U.S. PATENT DOCUMENTS

| | | | |
|---|---|---|---|
| D. 245,358 | 8/1977 | Barber | D34/5 |
| 3,059,926 | 10/1962 | Johnstone | 273/169 |
| 3,947,041 | 3/1976 | Barber | 273/167 G |
| 4,345,763 | 8/1982 | Swanson | 273/164 |
| 4,550,914 | 11/1985 | McCallister | 273/183 |
| 4,708,346 | 11/1987 | Pierce et al. | 273/164 |
| 4,753,440 | 6/1988 | Chorne | 273/164 |
| 4,787,636 | 11/1988 | Honma | 273/167 |

*Primary Examiner*—V. Millin
*Assistant Examiner*—Steven B. Wong
*Attorney, Agent, or Firm*—Poms, Smith, Lande & Rose

[57] ABSTRACT

A golf club head which includes a swing directing ridge which extends down the hosel and across the club head body. The ridge includes a front sloped surface and a back sloped surface which extend outward from the club head body and hosel to terminate in a crest. The slope of the front and back sloped surfaces are varied from forward slopes to rearward slopes at different portions of the hosel and club head body to provide a wave-like visual cue which promotes desirable golf swing characteristics.

8 Claims, 2 Drawing Sheets

Fig. 1.
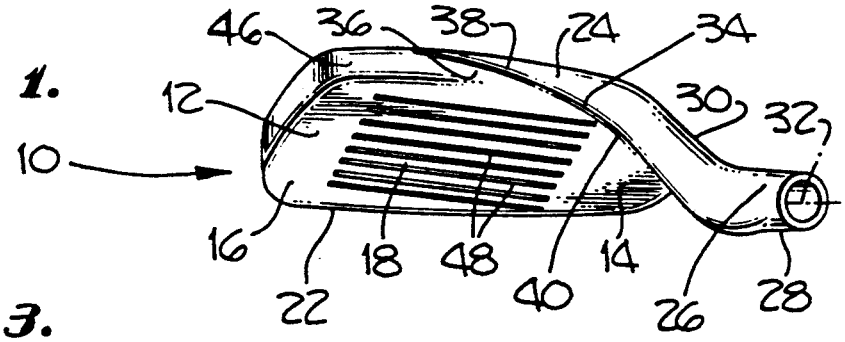
Fig. 3.
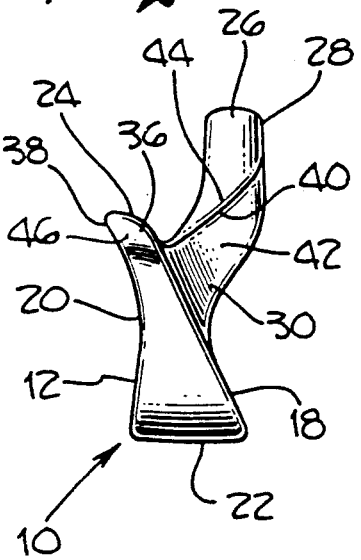
Fig. 2.
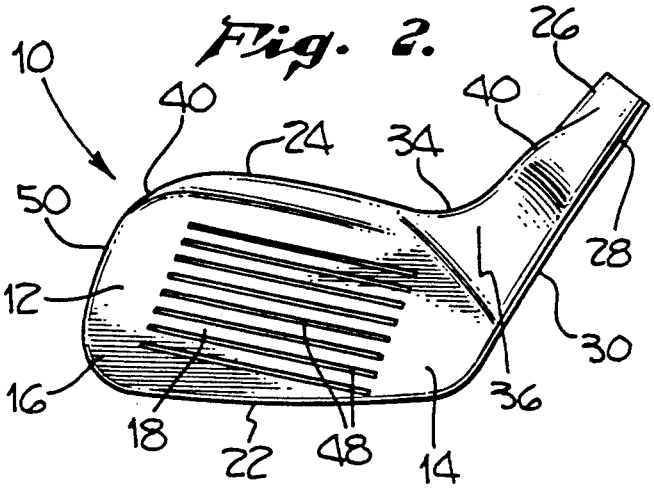
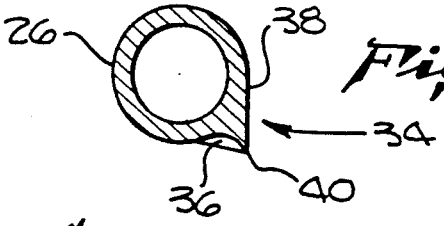
Fig. 6.
Fig. 4.
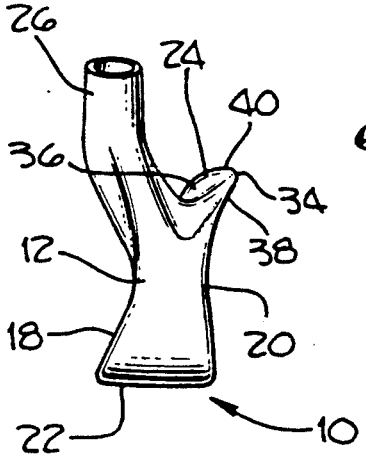
Fig. 5.
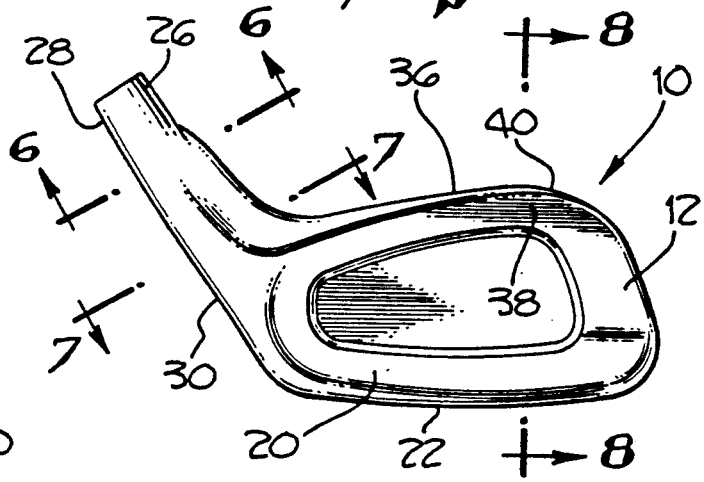

Fig. 7.
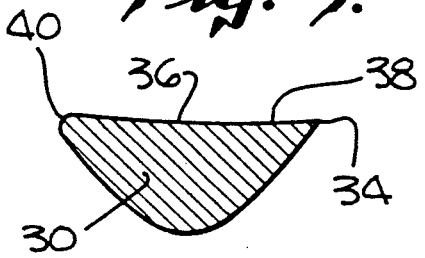
Fig. 8.
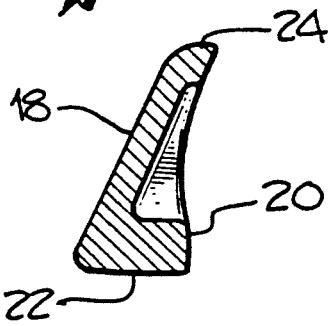
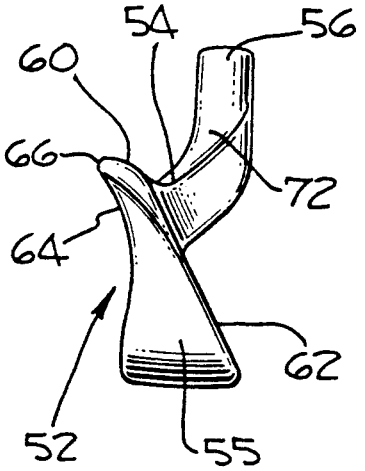
Fig. 9.
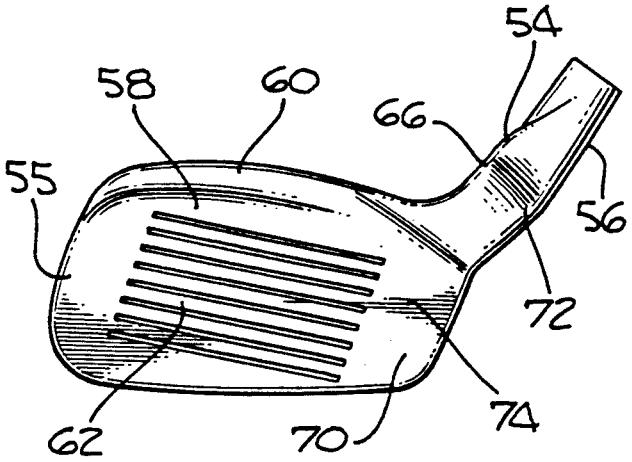
Fig. 10.
Fig. 12.
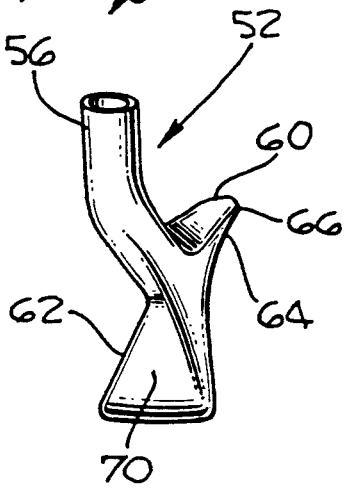
Fig. 11.
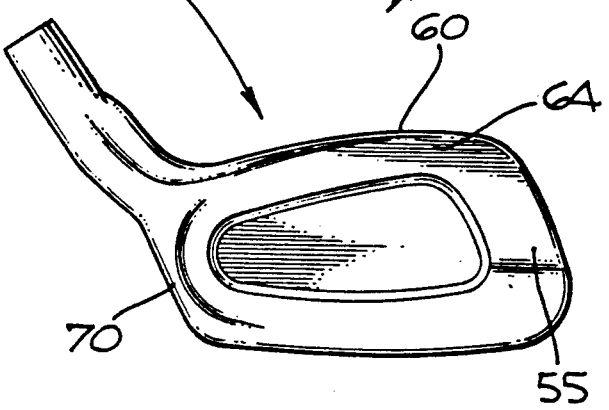

GOLF CLUB WITH SWING DIRECTING RIDGE

BACKGROUND OF THE INVENTION

1. Field of the Invention

The present invention relates generally to golf club heads which include visual indicators or cues designed to promote desirable golf swing characteristics. More particularly, the present invention relates to a golf club head having a raised ridge which extends down the hosel and across the club head body to provide a visual cue which promotes a golf swing having a number of desirable characteristics.

2. Description of Related Art

As is well known, golf clubs are generally of two types: the "wood" or distance clubs, and the "irons." Both types of clubs include a shaft having a grip portion on one end with a club head attached to the other end. A complete set of iron golf clubs typically includes nine clubs numbered 1 through 9. Additionally, the complete iron golf club set will include a sand wedge, a pitching wedge and may include various other specialty clubs.

The head of a conventional iron club is typically made from steel or steel alloys such as stainless steel which may or may not be chrome plated. The head may be cast, forged, or machined to provide a blade portion or club head body which is integral with a hosel or neck portion. The blade portion is used in striking the golf ball, with the hosel portion being designed to connect the blade with the club shaft. The irons have different shaft lengths and differing blade weights and blade loft angles to allow a golfer to hit the golf ball different distances using approximately the same golf swing.

The ultimate goal of the golf swing, regardless of the type of golf club being used is to hit the golf ball in a desired, preselected direction or line of flight. In general, the golfer positions himself so that his or her shoulders and feet are substantially parallel to the desired line of flight of the golf ball. The complete golf swing includes the back swing, the forward swing, and the follow through. Each phase of the golf swing requires a series of complex movements and body positionings which must be accurately controlled if the golf ball is to follow the intended line of flight.

There are many different ways to improve a golfer's ability to consistently control his golf shots. One approach is to modify the club head configuration to make up for inherent deficiencies in the golfer's swing. Such club heads are designed to provide relatively reproducible golf shots even though the golfer's swing may have a variety of inherent defects. Although this approach to improving a golfer's game is widely used, it does have its drawbacks in that the golfer's swing is not improved.

Another approach to improving the golfer's game is to provide the golfer with visual cues which promote a proper golf swing. In my prior U.S. Pat. No. 4,550,914, I disclose a club head which includes visual cues to the golfer which are designed to promote an inside-outside swing. The use of such visual cues on the golf club provides an effective means for prompting and promoting aspects of the golf swing, such as the inside-outside swing, which are generally believed to be necessary for a good golf swing.

Although the golf swing is made up of a large number of complex and interconnected movements, there are a number of features of the swing which are recognized as being desirable. For example, in addition to an inside-outside swing, it is recognized that it is desirable to have the club head face closing when the club head contacts the golf ball. If the golf ball is struck with the club head face in an "open" position, the ball has a tendency to slice away from its intended path. Accordingly, it would be desirable to provide a golf club head which includes one or more visual cues that promote a golf swing where the club face is closing when the golf ball is struck.

Many golfers have a tendency to move upward just prior to striking the golf ball. This tendency to "pull up" results in the golf ball being topped or even missed in severe cases. It would be desirable to provide a visual cue on the golf club head which prompts and promotes a golf swing wherein the tendency to pull up is reduced.

SUMMARY OF THE INVENTION

In accordance with the present invention, a golf club head is provided which includes visual cues that promote desirable golf swing characteristics. Among those characteristics promoted by the golf club head in accordance with the present invention are the closing of the golf club head face while striking the golf ball and the stationary positioning of the golfer to reduce the tendency to pull up just prior to hitting the golf ball.

The golf club head in accordance with the present invention includes a club head body or blade having a heel portion, a toe portion, a front face, a back, a bottom, and a top. The club head body is integrally connected to a hosel. The hosel includes a shaft portion having a shaft axis and a club head portion which is integrally connected to the heel portion of the club head body. As a feature of the present invention, a ridge extends from the hosel to the club head body. This ridge includes a front sloped surface and a back sloped surface wherein the front sloped surface and back slope surface extend outward from the club head body and hosel to terminate in a crest. This crest, which extends down the hosel and across the club head body provides a visual cue which can be used to promote desirable swing characteristics.

As a feature of the present invention, the front sloped surface of the ridge slopes forward relative to the club head body front face along at least a first portion of the ridge crest and transitions to a backward slope relative to the club head body front face along at least a second portion of the ridge crest. Likewise, the back slope surface slopes forward relative to the club head body front face along at least a first portion of the ridge crest and slopes backward relative to the club head body front face along at least a second portion of the ridge crest. The resulting variation in sloping of the front and back sloped surfaces produces a ridge having a closed appearance adjacent to the hosel and an open appearance adjacent to the club head toe. This transition from a closed to an open appearance across the top of the club head provides a visual cue to the golfer which promotes a closing club face when the golf ball is hit.

As another feature of the present invention, the ridge crest gradually transitions from the front of the hosel to the rear of the club head body top as it travels from the hosel to the club head body toe. This spiraling transition tends to visually connect the golfer to the crest which tends to enhance the effectiveness of the visual cue provided by the ridge.

As a further feature of the present invention, the ridge is shaped at the heel portion of the club head body in the form of a breaking wave which is breaking downward over the club head body face. The downward breaking wave tends to provide a visual cue which reduces the golfer's tendency to pull up during the golf swing. As a result, the golfer stays down over the ball and avoids the tendency to top or even miss the ball.

The above discussed and many other features and attendant advantages of the present invention will become apparent as the invention becomes better understood by reference to the following detailed description when considered in conjunction with the accompanying drawing.

BRIEF DESCRIPTION OF THE DRAWINGS

FIG. 1 is a top view of a preferred exemplary golf club head in accordance with the present invention.

FIG. 2 is a front view of the preferred exemplary golf club head shown in FIG. 1.

FIG. 3 is a toe end view of the preferred exemplary golf club head shown in FIG. 1.

FIG. 4 is a heel end view of the preferred exemplary golf club head shown in FIG. 1.

FIG. 5 is a rear view of the preferred exemplary golf club shown in FIG. 1.

FIG. 6 is a sectional view of FIG. 5 taken in the 6—6 plane.

FIG. 7 is a sectional view of FIG. 5 taken in the 6—6 plane.

FIG. 8 is a sectional view of FIG. 5 taken in the 8—8 plane.

FIG. 9 is a toe end view of a second preferred exemplary golf club head in accordance with the present invention.

FIG. 10 is a front view of the second preferred exemplary golf club head in accordance with the present invention.

FIG. 11 is a rear view of the second preferred exemplary golf club head in accordance with the present invention.

FIG. 12 is a heel end view of the second preferred exemplary golf club head in accordance with the present invention.

DETAILED DESCRIPTION OF THE INVENTION

A first preferred exemplary golf club head in accordance with the present invention is shown generally at 10 in FIGS. 1-8. The golf club head 10 includes a club head body 12 which includes a heel portion 14, toe portion 16, front face 18, back 20, bottom 22, and top 24. The club head body 12 is integrally connected to hosel 26. The hosel 26 includes a shaft portion 28 and a club body portion 30 which is integrally connected to the club head body heel portion 14. The hosel shaft has an axis represented by phantom line 32 which extends along the longitudinal axis of the hosel shaft 28.

In accordance with the present invention, a ridge 34 extends from the hosel 26 to and across the club head body 12. The ridge 34 includes a front sloped surface 36 and a back sloped surface 38. The front sloped surface 36 and back sloped surface 38 extend outward from the club head body 12 and the hosel 26 to terminate in a crest 40. The crest 40 extends from the hosel shaft 28 to the toe portion 16 of the club head body 12.

As best shown in FIG. 3, the front sloped surface 36 slopes forward relative to the club head body front face 18 along a first portion of the ridge shown at 42. The back sloped surface 38 also slopes forward relative to the club head body front face 18 as shown at 44 in FIG. 3. As a feature of the present invention, the slope of the front sloped surface 36 transitions from a forward slope to a rearward slope relative the front face 18 as the ridge approaches the toe end 16 of the club head body 12. This rearward sloping of the front sloped surface 36 is best shown in FIGS. 1 and 3 at 46. The back slope surface 38 also transitions from a forward slope in the first portion of the club head adjacent the hosel to a rearward slope as the ridge approaches the toe portion 16 of the club head body 12. The change in slope of the front sloped surface 36 and back slope surface 38 results in the ridge crest 40 travelling from the front of the club head body 12 to the back of the club head body 12 as the ridge crest 40 travels from the heel portion 14 of the club head body 12 to the toe portion 16 as best shown in FIG. 1.

As shown in FIGS. 1 and 6, the ridge crest 40 preferably spirals down from the front of the hosel shaft 28 around the shaft axis 32. The spiral gradually changes direction as it transverses the club head body from the heel portion 14 to the toe portion 16 as best shown in FIG. 1. The ridge crest 40, when viewed in combination with the front and back sloped surfaces 36 and 38 provides a wave-like visual cue which promotes a golf swing wherein the golfer closes the club head face as it approaches the golf ball. Further, the wave effect, in combination with the front and back sloped surfaces, promotes a swing wherein the golfer does not pull up during final stages of the swing prior to contacting the golf ball with the club head body 12.

The particular location and shape of the ridge, front and back sloped surfaces, and ridge crest may be varied to achieve different degrees of club head closing. For example, the ridge crest 40 may start at different locations vertically along the hosel shaft 28 and terminate at different locations along the toe portion 16 of the club head body. The degree of slope imparted to the front sloped surface 36 and back sloped surface 38 can also be varied depending upon the particular iron club and the degree of visual prompting desired. For certain irons, the degree of curving of crest 40 may be increased along with increases in slope angles of the front and back sloped surfaces to increase the visual effect of the ridge 34.

In the preferred embodiment shown in FIGS. 1-8, the face grooves 48 are preferably oriented in accordance with the teachings of my prior U.S. Pat. No. 4,550,914, the contents of which are hereby incorporated by reference. In addition, it is preferred that the toe end 50 be angled inward toward the hosel shaft axis in accordance with my prior U.S. patent to correspond to and enhance the inwardly sloping visual cue provided by the terminating ends of the base grid lines 48.

A second preferred exemplary golf club head in accordance with the present invention is shown generally at 52 in FIGS. 9-11. The club head 52 is similar to the first preferred exemplary embodiment in that it includes a ridge 54 which spirals down the hosel shaft 56 and extends onto the club head body 58. The club head 52 includes a toe portion 55 wherein the front sloped surface 60 slopes rearward relative the front face 62 and the back sloped surface 64 also slopes rearward with respect to front face 62. As best shown in FIG. 9, the slopes of front sloped surface 60 and back sloped surface 64 are slightly less than the slopes of the sloped surfaces shown in FIG. 1 for the toe portion of the club head body. The crest 66 on ridge 54 extends down the hosel 72 and all the way to the toe end of the club head body as best shown in FIG. 10. The principal difference between the second preferred exemplary embodiment and the first exemplary preferred embodiment is that the heel portion 70 of the second preferred exemplary embodiment is shaped differently so that the connection of the hosel 72 to the club head body 74 is narrower than the integral connection of the hosel and club head body utilized in the first preferred exemplary embodiment. The narrower hosel/club head body connection is best shown in FIGS. 10 and 11.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited by the specific embodiments as illustrated herein, but is only limited by the following claims.

What is claimed is:

1. A gold club head comprising:

a club head body comprising a heel portion, a toe portion, a front face, a back, a bottom and a top;

a hosel comprising a shaft portion having a shaft axis and a club body portion which is integrally connected to said club head body heel portion; and a ridge which extends from said hosel to said club head body, said ridge comprising a front slope surface and back slope surface wherein said front slope surface and back slope surface extend outward from said club head body and hosel to terminate in a crest, said crest extending from said hosel to said club head body, wherein said front slope surface slopes forward relative to said club head body front face along at least a fist portion of said ridge crest and wherein said front slope surface slopes backward relative to said club head body front fact along at least a second portion of said ridge crest.

2. A golf club head according to claim 1 wherein said back slope surface slopes forward relative to said club head body front face along a t least a first portion of said ridge crest and wherein said back slope surface slopes backward relative to said club head body front face along at least a second portion of said ridge crest.

3. A golf club head according to claim 2 wherein said ridge crest moves from the front of the club head body to the back of the club head body as said ridge crest travels from the heel portion of said club head body to the toe portion of said club head body.

4. A golf club head according to claim 2 wherein said first portion of said crest is located on said heel portion of said club head body and said second portion of said crest is located on said toe portion of said club head body.

5. A golf club head according to claim 1 wherein at least a portion of said crest is located forward of said club head body front face.

6. A golf club head according to claim 1 wherein said crest comprises an upper end which is located on the front of said hosel shaft and a lower end which is located on the top of said club head body at said toe portion.

7. A golf club head according to claim 1 wherein said first portion of said crest is located at said hosel and heel portion of said club body and wherein said second portion of said crest is located at the toe portion of said club body.

8. A golf club head according to claim 7 wherein said front slope face extends backward between said club head body front face and said crest.

* * * * *